US006428357B1

(12) United States Patent
Dolinshek et al.

(10) Patent No.: US 6,428,357 B1
(45) Date of Patent: Aug. 6, 2002

(54) ELECTRICAL CONNECTOR WITH OVERMOLD HOUSING

(75) Inventors: Thomas J. Dolinshek, New Baltimore; Daniel D. Robinson, Harrison Township; Walter Budd; Scott Wilton, both of Rochester, all of MI (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/883,187

(22) Filed: Jun. 19, 2001

(51) Int. Cl.[7] ..... H01R 13/58
(52) U.S. Cl. ..... 439/606; 29/856
(58) Field of Search ..... 439/606, 604, 439/610, 341, 372; 29/883, 858, 856

(56) References Cited

U.S. PATENT DOCUMENTS

| | | | | |
|---|---|---|---|---|
| 3,491,330 A | | 1/1970 | Barnhart et al. | 339/184 |
| 4,457,575 A | | 7/1984 | Davis et al. | 339/143 |
| 4,764,129 A | | 8/1988 | Jones et al. | 439/677 |
| 4,778,411 A | | 10/1988 | Rudy, Jr. et al. | 439/681 |
| 4,960,389 A | * | 10/1990 | Frantz et al. | 439/404 |
| 5,318,463 A | | 6/1994 | Broschard, III et al. | 439/540 |
| 5,342,221 A | | 8/1994 | Peterson | 439/677 |
| 5,383,790 A | | 1/1995 | Kerek et al. | 439/248 |
| 5,718,602 A | | 2/1998 | Savoca | 439/477 |
| 5,833,495 A | * | 11/1998 | Ito | 439/610 |
| 5,876,252 A | | 3/1999 | Hahn et al. | 439/701 |
| 6,113,415 A | | 9/2000 | Bertsch et al. | 439/353 |
| 6,152,778 A | | 11/2000 | Dalton | 439/638 |
| 6,168,475 B1 | | 1/2001 | Ko | 439/680 |
| 6,171,148 B1 | | 1/2001 | Chiu et al. | 439/607 |
| 6,179,658 B1 | | 1/2001 | Gunay et al. | 439/587 |
| 6,179,661 B1 | | 1/2001 | Chiou | 439/607 |
| 6,179,662 B1 | | 1/2001 | Kuo | 439/607 |
| 6,179,663 B1 | | 1/2001 | Bradley et al. | 439/608 |
| 6,179,667 B1 | | 1/2001 | Espenshade et al. | 439/676 |
| 6,206,734 B1 | * | 3/2001 | Liu | 439/676 |
| 6,230,405 B1 | * | 5/2001 | Liu et al. | 29/858 |

* cited by examiner

*Primary Examiner*—P. Austin Bradley
*Assistant Examiner*—Ross Gushi
(74) *Attorney, Agent, or Firm*—Blank Rome LLP

(57) ABSTRACT

An electrical connector assembly has an overmolded housing which is preferably injection-molded of thermoplastic resilient or elastic material onto a base housing containing an electrical connector. A strain relief is preferably integral with the overmolded housing. A pre-mold housing is preferably molded onto the base housing before the overmold housing.

12 Claims, 1 Drawing Sheet

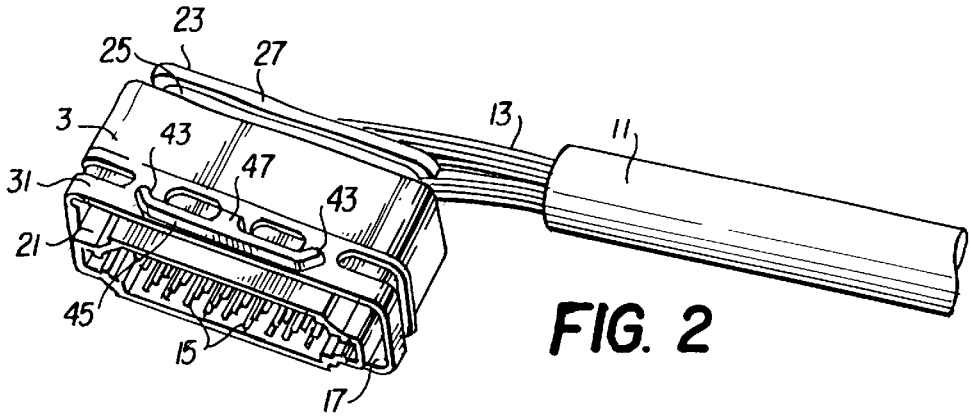
FIG. 2
FIG. 4
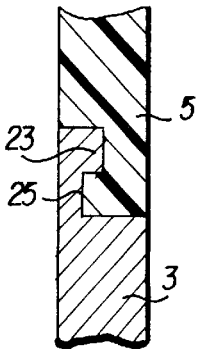
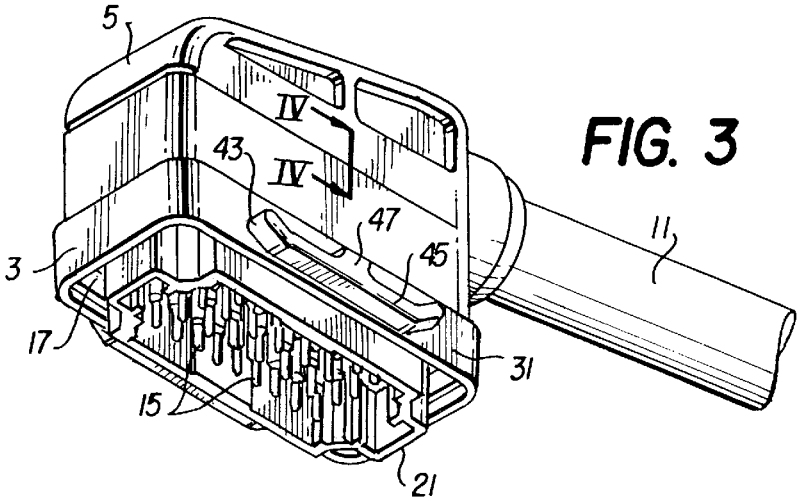
FIG. 3
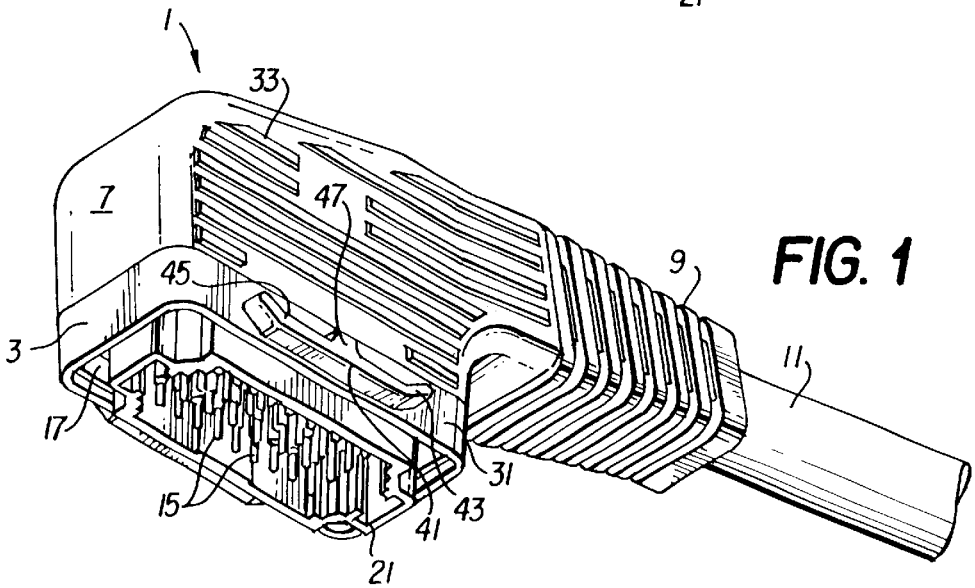
FIG. 1

ELECTRICAL CONNECTOR WITH OVERMOLD HOUSING

BACKGROUND OF THE INVENTION

1. Field of the Invention

The present invention relates to electrical connector housing construction.

2. Description of the Prior Art

A drawback of the electrical connectors of the prior art is that metallic outer connector housings have been made with strain reliefs and cable terminations that are fastened onto the rigid metal housing using hardware. The hardware typically consists of a threaded adapter and nut, a washer, and a rubber grommet. Tightening the nut compresses the grommet around the cable and provides a strain relief. This requires many parts and results in a heavy outer housing. In addition, the nut can come loose, allowing foreign contamination to enter and pulling the cable from the housing.

SUMMARY OF THE INVENTION

To overcome the deficiencies in the prior art as discussed above, the present invention provides an electrical connector comprised of a base housing which is overmolded in a plastic material to form an overmold housing. Preferably, the base housing is made of metal and the overmolding is cast around it in resilient plastic material that seals and provides a strain relief. A pre-mold housing is preferably applied to a portion of the base housing before the overmold housing is formed.

Other features of the invention may include: cable strain relief fittings to prevent damage to the plug-cord connection; use of special construction materials (i.e., die cast metal and plastics) that withstand chemical and high/low temperature environments; and audible and/or tactile confirmation that a latch is engaged.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 1 is a perspective view of an electrical connector cable assembly in accordance with the invention.

FIG. 2 is a perspective view of the base housing of the electrical connector of the invention.

FIG. 3 is a perspective view of the base housing with a pre-mold housing formed thereon;

FIG. 4 is a partial cross-sectional view along lines IV—IV of FIG. 3.

DETAILED DESCRIPTION OF THE INVENTION

FIG. 1 shows the electrical connector of the invention. The connector 1 is comprised of three main parts, a base housing 3, a pre-mold housing 5 molded onto a rear portion of the base housing (see, FIG. 3) and an overmolded housing 7, which is molded over the pre-mold housing, as described in more detail below.

The overmolded housing 7 is preferably molded of plastic material with resilience or elasticity, such as a thermoplastic elastomeric material, although hardened plastic, such as thermosetting material, may be also used. The overmolded housing 7 preferably includes a strain relief extension 9 molded around the cable 11 which supplies the wires 13 which enter the rear of the base housing 3 and are attached to the contacts 15 of internal connector 21.

FIG. 2 shows base housing 3 which includes internal connector 21 disposed in passageway 17 having electrical contacts 15 which are attached to wires 13 which enter through an open rear of base housing 3 from cable 11. The rear portion of base housing 23 includes a circumferential groove 25 and flange 27, which aid in the attachment of the pre-mold housing as discussed below.

FIG. 3 shows base housing 3 with pre-mold housing 5, molded thereon. Pre-mold housing 5 may be molded from any of the thermoplastic or thermosetting plastic materials used for the overmolded housing. To attach the pre-mold housing 5 to the base housing 3, the base housing with attached cable is placed in a mold and the pre-mold housing is molded thereon, covering the rear portion of the base housing 23, wires 13 and a portion of cable 11, as shown in FIG. 3.

The pre-mold and overmold housing are preferably made by injection molding plastic material into the mold to form the structures shown in FIGS. 1 and 3.

To facilitate attachment of the pre-mold housing to the rear of the base housing, a circumferential groove 25 and flange 27 are preferably provided on the rear of the base housing. As shown in FIG. 4, the material which forms the pre-mold housing is held in groove 25, locking the pre-mold housing to the base housing.

Overmolded housing 7 is then molded over the pre-mold housing and central portion 29 of base housing 3 to form the connector of the invention shown in FIG. 1. Overmold housing 7 is, preferably, molded such that its outer surface is flushed with the outer surface of the exposed front portion of base housing 31. The surface of the overmold housing may contain ribs 33 to facilitate gripping of the connector.

In a preferred embodiment, the front portion 31 of the base housing 3 is provided with lug ridge 41. The lug ridge 41 is an optional feature that is preferably cast into base housing 3. It includes two rounded ends 43, reinforcement members 45, and a reinforcement extension 47. The mating connector (not shown) includes two latches having detents, on swing arms, that catch onto the rounded ends 43. The latches are shown in the co-pending application entitled "General Motion Connector," Ser. No. 09/805,330, filed Mar. 14, 2001, the contents of which are entirely incorporated herein by reference. The rounded ends 43 take the place of cylindrical lug pins, which are prone to break under the high forces exerted by the latches.

The reinforcement members 45 are preferably of the same height above the surface of the housing as is the rounded ends 43, but may be of a different height. The same is true of the extension 47.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An electrical connector assembly comprising:

an electrical connector having one or more electrical contacts;

a base housing surrounding said electrical connector, said base housing having a passageway through for receiving said electrical connector, a first opening at one end of the passageway to permit said electrical connector to mate with another electrical component, a second opening at another end of the passageway for receiving one or more wires for attachment to one or more contacts in said electrical connector, and a lug adapted to engage a latch-arm detent in a locking position, the lug including two rounded ends, reinforcement members, and a reinforcement extension;

a cable having one or more wires which run from the cable through said second opening of the base housing and attach to said one or more contacts of the electrical connector; and an overmold housing which covers said second opening of the base housing, said one or more wires and a portion of said cable.

2. The electrical connector assembly as claimed in claim 1, further comprising a pre-mold housing formed over said second opening of the base housing, beneath said overmold housing.

3. The electrical connector as claimed in claim 2, wherein the end of the base housing adjacent the second opening of the base housing comprises a circumferential groove and flange.

4. The electrical connector assembly as claimed in claim 3, wherein said flange is embedded in said pre-mold housing.

5. The electrical connector assembly as claimed in claim 1, wherein said overmold housing is made of an elastomeric material.

6. The electrical connector assembly as claimed in claim 5, wherein said base housing is made of metal.

7. The electrical connector assembly as claimed in claim 1, wherein the outer exposed surface of said overmold housing is flush with the outer exposed surface of the base housing.

8. The electrical connector assembly as claimed in claim 1, wherein the overmold housing comprises a strain relief extension attached to said cable.

9. A method of assembling an electrical cable assembly comprising:

positioning an electrical connector within a passageway in a base housing having a first opening to permit the electrical connector to mate with another electrical component and a second opening which receives one or more wires from an electrical cable which are attached to one or more contacts in the electrical connector;

forming a lug on the base housing to engage a latch-arm detent in a locking position, the step of forming the lop including the steps of forming two rounded ends, forming reinforcement members, and forming a reinforcement extension;

overmolding a plastic pre-mold housing onto the base housing over the second opening; and overmolding a plastic overmold housing over the pre-mold housing, base housing and cable.

10. The method as claimed in claim 9, comprising forming a flush outer surface common to the exposed outer surface of the base housing and the exposed outer surface of the overmold housing.

11. The method as claimed in claim 9, wherein said pre-mold housing and overmold housing are formed of an elastomeric material.

12. The method as claimed in claim 9, wherein the step of overmolding comprises forming a strain relief extension around the cable.

* * * * *